US010807140B2

(12) United States Patent
Laszczyk et al.

(10) Patent No.: US 10,807,140 B2
(45) Date of Patent: Oct. 20, 2020

(54) OPTIMIZED DRAWING AND WALL IRONING PROCESS OF ALUMINUM CONTAINERS

(71) Applicants: CONSTELLIUM NEUF-BRISACH, Biesheim (FR); SANDVIK INTELLECTUAL PROPERTY AB, Sandviken (SE)

(72) Inventors: Laurent Laszczyk, Rielasingen-worblingen (DE); Hervé Stoppiglia, Meylan (FR); Victor Rimbau-Gilabert, Barcelone (ES); David P. Lieb, Beulah, CO (US)

(73) Assignees: CONSTELLIUM NEUF-BRISACH, Biesheim (FR); Sandvik Intellectual Property AB, Sandviken (SE)

( * ) Notice: Subject to any disclaimer, the term of this patent is extended or adjusted under 35 U.S.C. 154(b) by 213 days.

(21) Appl. No.: 15/747,680

(22) PCT Filed: Jul. 22, 2016

(86) PCT No.: PCT/EP2016/067519
§ 371 (c)(1),
(2) Date: Jan. 25, 2018

(87) PCT Pub. No.: WO2017/017009
PCT Pub. Date: Feb. 2, 2017

(65) Prior Publication Data

US 2018/0161842 A1 Jun. 14, 2018

(30) Foreign Application Priority Data

Jul. 27, 2015 (EP) ..... 15178538

(51) Int. Cl.
*B21D 22/20* (2006.01)
*B21D 22/30* (2006.01)
(Continued)

(52) U.S. Cl.
CPC ..... *B21D 22/201* (2013.01); *B21D 22/025* (2013.01); *B21D 22/28* (2013.01); *B21D 22/30* (2013.01)

(58) Field of Classification Search
CPC .... B21D 22/20; B21D 22/201; B21D 22/283; B21D 22/28; B21D 22/025; B21D 22/30
See application file for complete search history.

(56) References Cited

U.S. PATENT DOCUMENTS 3,942,351 A * 3/1976 Avitzur ..... B21D 22/20 72/271
5,250,364 A 10/1993 Hector, Jr. et al.
2013/0205862 A1* 8/2013 Takahashi ..... B21D 22/286 72/342.3

FOREIGN PATENT DOCUMENTS

GB 1400081 A 7/1975
JP S55158838 A 12/1980
(Continued)

OTHER PUBLICATIONS

EPO Machine Translation of JP-07068326-A (Year: 2020).*
(Continued)

*Primary Examiner* — Pradeep C Battula
(74) *Attorney, Agent, or Firm* — McBee Moore & Vanik IP, LLC

(57) ABSTRACT

The invention relates to a manufacturing process of aluminum alloy beverage cans by «Drawing-Ironing», characterized in that a friction higher between the bodymaker punch and the aluminum sheet than between the ironing die and said aluminum sheet is produced by at least one of the following specificities:

An aluminum sheet with an internal surface significantly higher in roughness than the external one Ironing dies with rounded intersections between infeed as well as exit surface and the land, with a smooth surface in the working area and a short width of the land (Continued)

A bodymaker punch with an extra roughness and an isotropic texture.

It also relates to a beverage can manufactured by such a process, and characterized in that its reflectance measured at 60° is higher than 73% just after the last ironing step.

11 Claims, 4 Drawing Sheets

(51) Int. Cl.
*B21D 22/02* (2006.01)
*B21D 22/28* (2006.01)

(56) References Cited

FOREIGN PATENT DOCUMENTS

| | | | | |
|---|---|---|---|---|
| JP | S57 7334 | A | | 1/1982 |
| JP | S61 212428 | A | | 9/1986 |
| JP | 62254927 | A | * | 11/1987 |
| JP | 07068326 | A | * | 3/1995 |
| JP | H09285828 | A | | 11/1997 |
| JP | 10137861 | A | * | 5/1998 |
| JP | 2944905 | B2 | | 9/1999 |
| JP | H11267769 | A | | 10/1999 |
| JP | 3044920 | B2 | | 5/2000 |
| JP | 3219311 | B2 | | 10/2001 |
| JP | 2004154783 | A | | 6/2004 |
| JP | 2007 275947 | A | | 10/2007 |
| JP | 4753429 | B2 | | 8/2011 |

OTHER PUBLICATIONS

EPO Machine Translation of JP-10137861-A (Year: 2020).*
EPO Machine Translation of JP-62254927-A (Year: 2020).*
International Search Report of International Patent Application No. PCT/EP2016/067519 dated Sep. 26, 2016.

* cited by examiner

OPTIMIZED DRAWING AND WALL IRONING PROCESS OF ALUMINUM CONTAINERS

CROSS-REFERENCE TO RELATED APPLICATIONS

This application is a National Stage entry of International Application No. PCT/EP2016/067519, filed 22 Jul. 2016, which claims priority to European Patent Application No. 15178538.3, filed 27 Jul. 2015.

FIELD

Technical Field

The invention relates to the field of beverage cans made of aluminum alloy, also known to those skilled in the art as «cans», or «beverage cans» or even «two-piece beer and beverage cans», or aluminum containers, manufactured by drawing-ironing, i.e. according to a method particularly including these two basic steps.

The invention relates more particularly to an optimized ironing method for this type of application and particularly having the advantage of providing a lower tear-off rate, better can geometry consistency and better can surface aspect.

This improvement is obtained through a controlled roughness and texture of the punch, ironing die geometry (land width, roughness of the working area, inlet geometry) as well as the aluminum sheet (internal and external roughness of the metal) and cupper lubrication.

Description of Related Art

Unless specified the aluminum alloys hereinafter are designated, otherwise, according to the designations defined by the «Aluminum Association» in the «Registration Record Series» published regularly by this association.

Unless otherwise stated, the definitions of metallurgical tempers listed in the European standard EN 515 will apply. Static tensile mechanical characteristics, in other words, the ultimate tensile strength $R_m$ (or UTS), the tensile yield strength at 0.2% plastic elongation $R_{p0.2}$ (or YTS), and elongation A % (or E %), are determined by a tensile test according to NF EN ISO 6892-1.

Aluminum alloys are increasingly used in the manufacture of containers, and more specifically beverage cans, due to the very appealing visual appearance thereof, particularly compared to plastics or steels, the suitability thereof for recycling and the high corrosion resistance thereof.

Beverage cans, also known by those skilled in the art as «cans» or «two-piece beverage cans», are usually manufactured by drawing-ironing using sheets of 3104 type alloy in the H19 metallurgic temper with a gauge between 0.2 and 0.3 mm.

The sheet undergoes a first operation for cupping which consists in blanking and drawing; more specifically, during this step, the coil of sheet feeds a press, also known as a «cupper», which cuts disks known as blanks and performs a first deep-drawing operation to produce «cups».

The cups are then conveyed to a second press or «bodymaker» where they undergo at least one second deep drawing operation and a plurality of successive ironing operations; these consist of passing the deep-drawn blank through ironing tools, known as rings or dies, in order to elongate and thin the metal.

The bottom of the can is also shaped at this time. The malleable metal is formed to an open-top cylindrical container. The sidewall of the can is significantly thinner than the bottom (dome) which remains unironed and close to original starter gauge. The sidewall of the can consists of what is commonly known as mid-wall and top-wall (see FIG. 1).

The can is then trimmed in a rotary machine to the desired height.

During the ironing process, a tear-off can occur (sidewall break or failure during ironing process) causing stoppage of bodymaker which reduces the line performance. Moreover, after ironing, the shiny aspect of the cans can vary a lot.

According Avitzur (1983) it is known (see FIG. 2) that «the punch force [ . . . ] is transmitted to the deformation zone [ . . . ] partly through pressure on the bottom of the cup, further transmitted by tension on the wall, and partly through friction. As the friction between the punch and the inner surface of the cup increases, less tension is exerted on the wall, thus enabling ironing with larger reduction. By differential friction (i.e. by having the ram friction higher than the die friction) and proper choice of die angle, unlimited amounts of reduction can in principle be achieved through a single die. . . . In practice, until recently, only small reductions were obtained in a single draw through one die. . . . "

Patent application GB1400081 (Avitzur) discloses a deep drawing process wherein hollow work is wall-ironed through a conical die by a punch with a larger frictional face at the punch that at the die so that tensile stress in the ironed zone is reduced or eliminated.

Patent application JPS577334A (Kishimoto Akira) discloses a punch with specified shape, depth and intervals of circumferential groove lines, designed to improve removal of a can and to improve formability in ironing of a can body. The punch texture is not isotropic.

Patent application JP2007275847 (Daiwa Can) discloses a punch for ironing whose outer circumferential face is divided into two parts, in such a manner that the part at the tip side is rough and the part at the terminal side is smooth.

Patent application JPS61212428 (Nippon Steel) discloses steel plates with improved ironing and strip-out workability having respective roughened surfaces differing from each other on the face and back.

U.S. Pat. No. 5,250,634 (Aluminum Company of America) discloses a metal sheet for making rigid container products having a fissureless surface that retains minute amounts of lubricant.

Moreover, according to the present state of the art, interactions between metal and tooling, i.e. between punch and metal as well as die and metal, are controlled using the following specifications:

- Metal roughness Ra is between 0.3 and 0.5 μm on both sides.
- Cupper lubrication is made up of two components: post-lube and cupper lube. Post lube is applied by aluminum manufacturer at an average level of 500 mg/m$^2$ for both sides and cupper lube is applied at the cupping press at a level of 500 to 1100 mg/m$^2$ for both sides. Thus the total amount of lube (post-lube plus cupper lube) is between 1000 and 1600 mg/m$^2$; more specifically, for a 33c1 can, it means 16 to 24 mg per cup. The distribution of lube between the two sides of the metal sheet is from 50 to 60% for the external side and from 40 to 50% for the internal side.

Bodymaker punches are delivered with both polished and ground surfaces, nose radius and rework taper polished (Ra≤0.05 μm), main body ground (Ra≤0.3 μm).

Bodymaker punches are textured by canmaker with a process commonly known by industry as crosshatching. This process varies by canmaker and at times can be poorly controlled.

Working surface of ironing dies is defined by infeed angle (1), land width (2) and its angle (3), the intersection point (5) between infeed surface (7) and land, exit angle (4) and surface roughness of those areas (see FIG. 3). Typically industry is using an infeed angle between 7 and 8°, land width between 0.38 and 0.76 mm; the land angle (3) can be between 0 to 5' making a larger diameter towards the exit of the land; intersection points (5) and (6) are called out sharp respectively between infeed surface (7) and land (8) and between land and exit surface (9); the exit angle (4) is between 2° and 8° and the surface roughness is typically specified as Ra≤0.05 μm or Ra≤0.10 μm. Currently average tear-off rates are between 20 ppm and 150 ppm obtained with standard three ironing die progression, with a third die effective ironing ratio between 38% and 44%. Standard 60° reflectance of cans is below 73%. Typical top-wall thickness variability is around 11 μm.

Because of the tremendous volume of beverage cans manufactured each year (320 billion), each slight improvement in the manufacturing process can result in tremendous savings.

Problem

The problem to solve is to identify the best ironing conditions which guarantee a high manufacturing productivity, like a low tear-off rate or a low necking spoilage rate on a long period of time and on a steady manner.

The shiny aspect of the external wall of the can preforms after ironing is a key property for the quality of the visual aspect of the final can product after decoration. The problem to solve is to identify the best ironing conditions which maximize the reflectance measured at 60°, while keeping at a reasonable level the previously mentioned manufacturing productivity. Finally, one of the main objectives is to reduce the amount of metal into the can. It could be done by reducing the thickness of either the top-wall, the mid-wall or the dome. The problem to solve is to identify the best ironing conditions that enable to reduce by all means these thicknesses, while keeping at a reasonable level the previously mentioned manufacturing productivity.

SUMMARY

The invention relates to a manufacturing process of aluminum alloy beverage cans by «Drawing—Ironing», characterized in that a friction higher between the bodymaker punch and the aluminum sheet than between the ironing die and said aluminum sheet is produced by at least one of the following specificities:

An aluminum sheet with an internal surface significantly higher in roughness than the external one, typically Ra>0.4 μm compared with Ra<0.3 μm Ironing dies with a rounded intersection between infeed as well as exit surface and land, with a surface in the working area having Ra below about 0.03 μm and with a width of the land below about 0.38 mm, A bodymaker punch with an extra roughness, with a roughness Ra above 0.35 μm, and an isotropic texture.

With this purpose, either it uses as material an aluminum alloy sheet with an external surface in contact with dies, with a roughness Ra typically below 0.3 μm, and an internal one in contact with the punch, with a roughness Ra typically above 0.4 μm, and/or a punch with an extra roughness characterized by Ra above 0.35 μm, with an isotropic texture and/or ironing dies with rounded intersection (5) advantageously with a radius from 0.5 to 4.6 mm between infeed surface (7) and land (8), which is the working area, rounded intersection (6) with a radius below 1.2 mm between land and exit surface (9), roughness Ra below 0.03 μm in the working area (see FIG. 4) and a short land width, typically below 0.38 mm.

It also relates to a manufacturing process of aluminum alloy beverage cans by «Drawing-Ironing» characterized in that it uses a smooth surface aluminum sheet on both sides either in combination with an extra rough punch as defined above.

Advantageously the manufacturing process of the invention uses no internal cupper lubrication.

The invention also relates to a beverage can manufactured by a process such as one described above, characterized in that its reflectance measured at 60° is higher than 73% just after the last ironing step, i.e. before and without any complementary surface treatment.

It has to be noted that the value of 73% is a mean value. For example, relating to FIG. 5 or 8, each point on the graph is a mean value, obtained per run of about 8'000 to 10'000 cans, and calculated on three cans and ten measurements per can.

The invention also relates to an ironing die for a manufacturing process of aluminum alloy beverage cans by «Drawing-Ironing», characterized in that it has a rounded intersection (5) with a radius from 0.5 to 4.6 mm between infeed surface (7) and land (8), a rounded intersection (6) with a radius below 1.2 mm between land and exit surface (9), a surface in the working area having a roughness Ra below 0.03 μm and a width of the land below 0.38 mm.

Finaly the invention also relates to a bodymaker punch for a manufacturing process of aluminum alloy beverage cans by «Drawing-Ironing» characterized in that it has a roughness Ra above 0.35 μm and an isotropic texture.

DETAILED DESCRIPTION OF A PREFERRED EMBODIMENT

Figure 1:
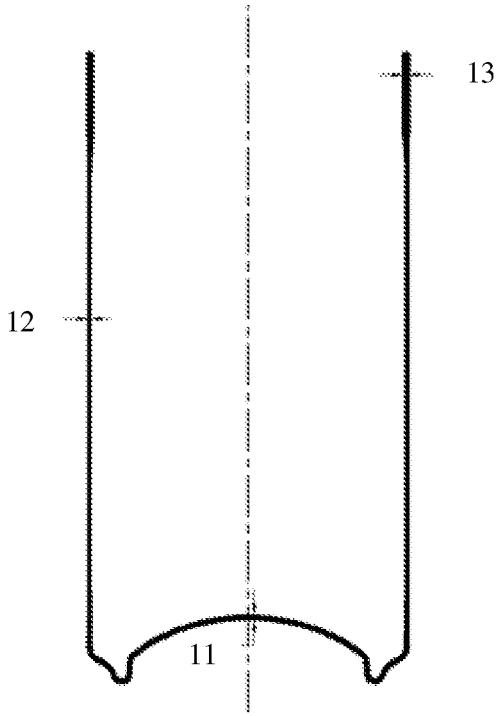
FIG. 1 represents the body of a typical «beverage can», with the «bottom» (dome) (11), the «mid-wall» (12) and the «top-wall» (13).
Figure 2:
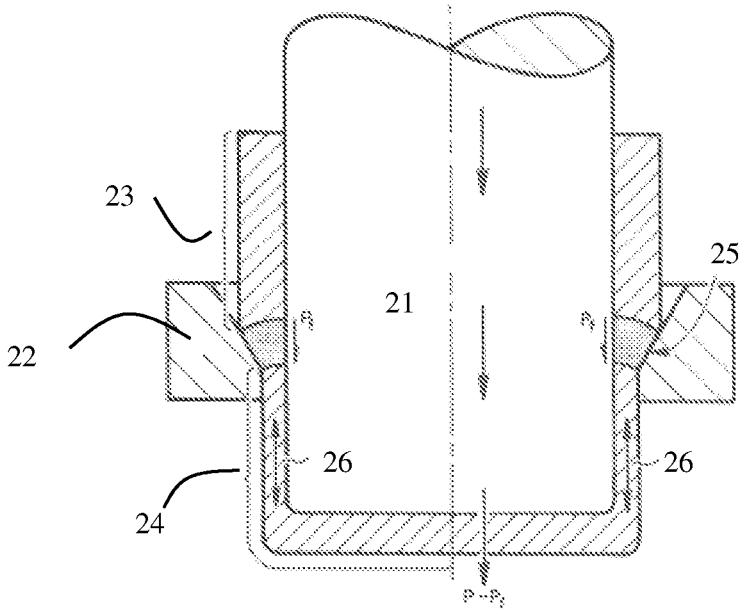
FIG. 2 represents an ironing step with the punch (21), the die (22), the «Not yet deformed zone» (23), the «Already deformed zone» (24), the «Deformation zone (25) and the «Wall tension zone» (26).
Figure 3:
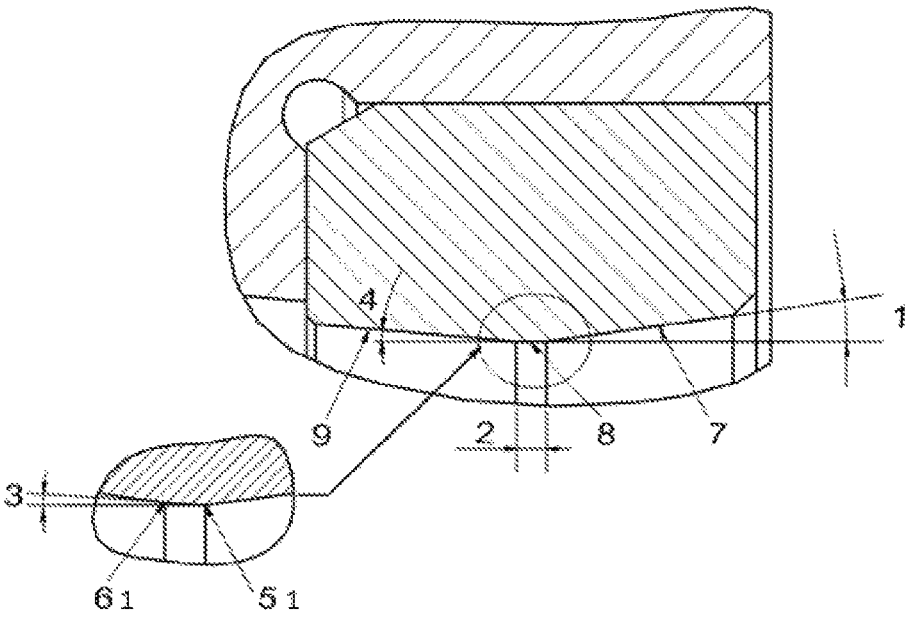
FIG. 3 represents the «working surface of ironing die», according to state of the art, with the «infeed angle» (1), «land width» (2), «land angle» (3), «exit angle» (4), «the sharp intersection point between infeed surface and land» (51), «the sharp intersection point between land angle exit angle» (61), «infeed surface» (7), «land surface» (8), «exit surface» (9).

The shiny aspect of the external wall after ironing is a key property for the quality of the visual aspect of the final product after decoration. This property can be qualitatively assessed using haze effect and image clarity.

One of the most appropriated measurements to assess it quantitatively is the specular reflectance at 60° with respect to the normal of the flattened can wall. All the reflectance measurements discussed in this document have been performed on preforms of cans after ironing and washing operation similar to what is done in a can making plant.

The roughness is measured according to standard NF EN ISO 4287. An isotropic texture is a texture for which roughness measurement does not depend on the measuring direction. For a roughness Ra above 0.35 μm and an isotropic texture, the roughness Ra is above 0.35 μm for any measurement direction.

In order to solve the problem, the invention aims at increasing the friction between punch and metal and, in the same time, at reducing the friction between ironing dies and metal. Thus, a friction higher between the bodymaker punch and the aluminum sheet than between the ironing die and said aluminum sheet is produced.

With this purpose, several solutions are efficient used separately or combined.

A first embodiment consists in using metal, i.e. an aluminum alloy sheet, with differentiated roughness. More precisely, it means an externally smooth surface, characterized by Ra below 0.3 μm, in contact with dies, and an internally rough one, in contact with the punch, characterized by Ra above 0.4 μm.

The main advantage of using smooth metal externally is to improve the brightness of the can, with a 60° reflectance at least of 73%. On the other hand, providing rough metal internally contributes to increase friction with the punch and, therefore, decrease tear-off rate.

At a given top-wall thickness, the down gauging of the mid-wall is constraint by the ironing ratio of the third die. By using metal with differentiated roughness, specifically with higher roughness internally, the limit third ironing ratio can be increased to higher than 44% and consequently the mid-wall thickness can be reduced.

A second embodiment consists in using a punch with an extra roughness characterized by Ra above 0.35 μm, with an isotropic texture, compared to current cross-hatching practices, well known from the one skilled in the art. It enables to increase drastically internal friction and, as a consequence, to decrease the tear-off rate or increase the ironing ratio to higher than 44% with the same tear-off rate.

With a given top-wall thickness, down gauging of the mid-wall is constraint by the ironing ratio of the third die. By using an extra rough punch, the limit third ironing ratio can be increased to higher than 44% and consequently the mid-wall thickness can be reduced.

Preferably the manufacturing process of the invention is working with no internal cupper lubrication. It enables to increase the internal friction and, consequently, to decrease the tear-off rate or increase the ironing ratio at the same tear-off rate.

For a given top-wall thickness, the down gauging of the mid-wall is constraint by the ironing ratio of the third die, which cannot over-pass the so-called "Limit Ironing Ratio". Above this upper limit, no ironing is feasible without failure. Without any internal cupper lubrication the "Limit Ironing Ratio" increases such that third ironing ratios higher than 44% can be industrially performed. Consequently, the mid-wall thickness can be reduced.

A variant consisting in using a smooth surface sheet on both sides does contribute to increase the tear-off rate by decreasing the friction between punch and metal. Nevertheless, such a negative consequence can be prevented by using in combination an extra rough punch or no internal cupper lubrication.

Figure 4:
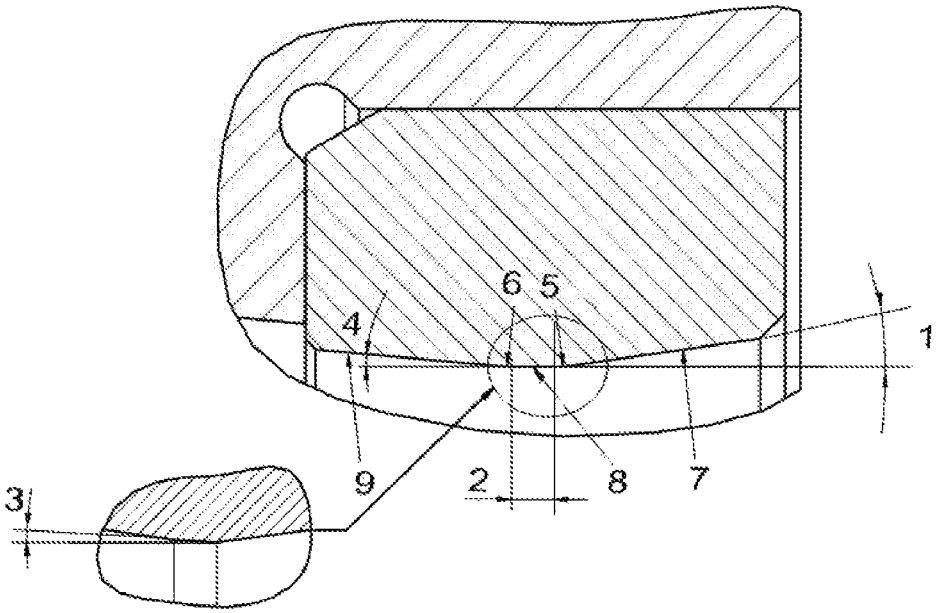
FIG. 4 represents the «working surface of ironing die with rounded intersection», according to the embodiments, with the «infeed angle» (1), «land width» (2), «land angle» (3), «exit angle» (4), «rounded intersection between infeed surface and land» (5), «rounded intersection between exit surface and land» (6), «infeed surface» (7), «land surface» (8), «exit surface» (9).

A third embodiment consists in using ironing dies with rounded intersection (5) with a radius from 0.5 to 4.6 mm between infeed surface (7) and land (8), which is the working area, rounded intersection (6) with a radius below 1.2 mm between land and exit surface (9), roughness Ra below 0.03 μm in the working area (see FIG. 4), and a short land width below 0.38 mm.

This enables to better control the top-wall thickness, typically dividing by two the current variability, and it contributes to improve the can wall brightness, i.e. a 60° reflectance higher than 73%.

The necking line efficiency is sensitive to top-wall thickness variability, higher variability inducing lower efficiency. Rounded ironing dies, with Ra below 0.03 μm in the working area and/or shorter land width, typically below 0.38 mm, enables to improve the top-wall consistency and thus improve the necking line efficiency.

Rounded ironing dies, with Ra below 0.03 μm in the working area and/or land width, typically below 0.38 mm, enables to improve the top-wall consistency and thus reduce the top-wall thickness target for the same lower specification limit.

EXAMPLES

Some examples of the described above correlation between metal, tools and manufacturing parameters on one side, and manufacturing productivity and shiny aspect of the can on the other side, have been obtained during several trial campaigns, using sheets of 3104 type alloy in the H19 metallurgic temper with a gauge of 0.26 mm, on a prototyping drawing-ironing front-end line. For each run with a fixed set of conditions, around 10'000 cans are produced and occurrences of tear-off are counted. The thicknesses, the weight and the reflectance of the can preforms are measured on samples taken from the beginning, the middle and the end of the run.

Figure 5:
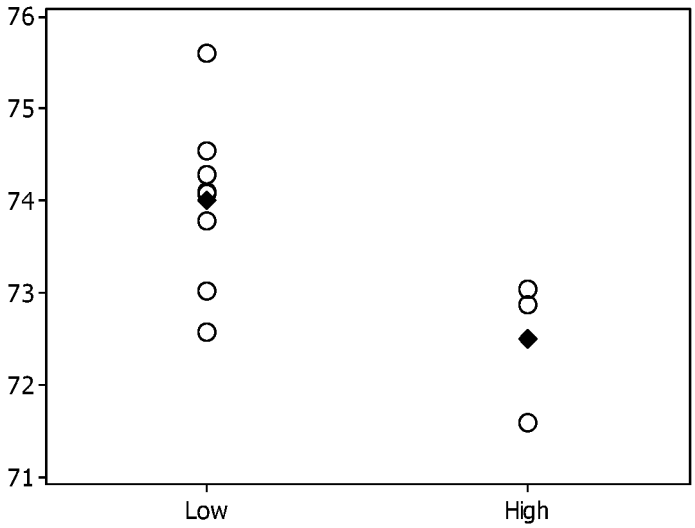
FIG. 5 represents the «Reflectance measured at 60°» in % as a function of «Metal roughness»:low roughness is 0.23 μm and high roughness 0.49 μm. The diamond point is the mean value.

The first example compares several runs performed with a metal taken from the same mother coil but with two different surface finishing: one with low roughness (Ra of 0.23 μm) and another one with high roughness (Ra of 0.49 μm). FIG. 5 compares the impact of this symmetrical, that is to say identical on both sides, metal roughness on the can wall reflectance after ironing. Low roughness gives in average a higher reflectance. Each point on FIG. 5 is an average value per run of about 10'000 cans calculated on three cans and ten measurements per can.

Figure 6:
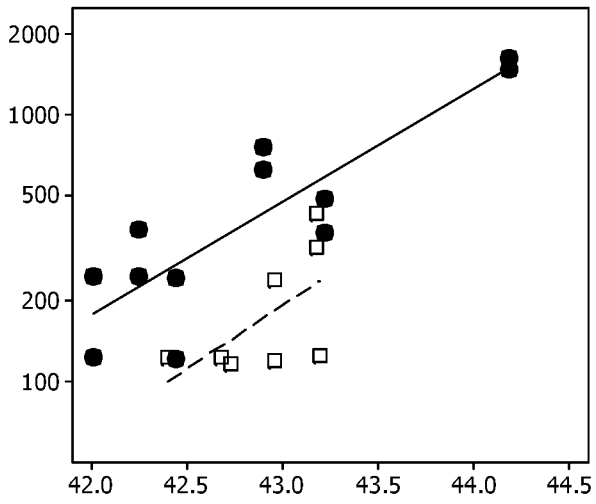
FIG. 6 represents the «Tear-off ratio» in ppm as a function of the «Third ironing ratio» in %, and in black for a punch roughness Ra of 0.20 μm, in white for a roughness Ra of 0.47 μm.

The second example compares several runs performed with two punches with the same textured surface finishing but different roughness Ra respectively of 0.20 μm and 0.47 μm. FIG. 6 shows that increasing the punch roughness reduces the tear-off rate in average on several third ironing ratios. Each point on FIG. 6 is obtained with a trial of about 8'000 cans with the same first and second ironing ratio.

Figure 7:
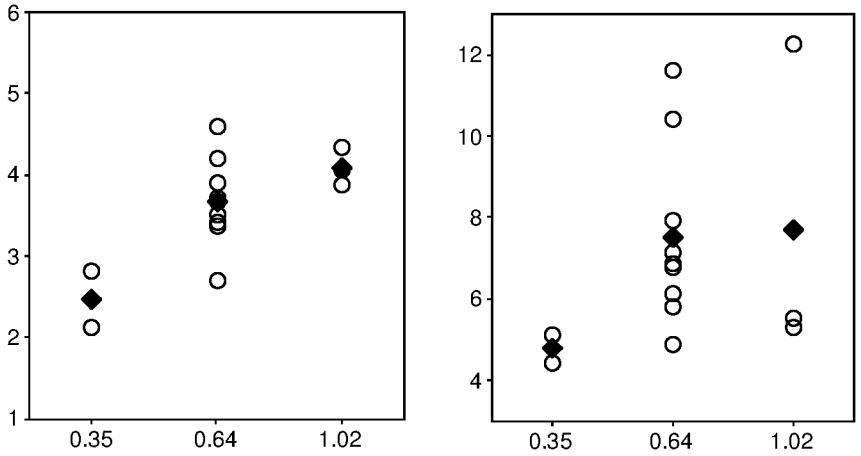
FIG. 7 represents the average thickness range (maximum minus minimum values) in μm as a function of the land width in mm, on the left for the mid-wall (12) (FIG. 1) and on the right for the top-wall (13) (FIG. 1).

The third example concerns the variability of the wall thicknesses of the can during a run of production. FIG. 7 shows that the land width impacts the mid-wall and top-wall thicknesses: the shortest is the land size, the most focused is the distribution of thicknesses. Each point on FIG. 7 is an average of 4 measurements per can on about 30 samples taken among a run of about 10'000 cans. All the runs compared have been done with the same punch but different die designs.

Figure 8:
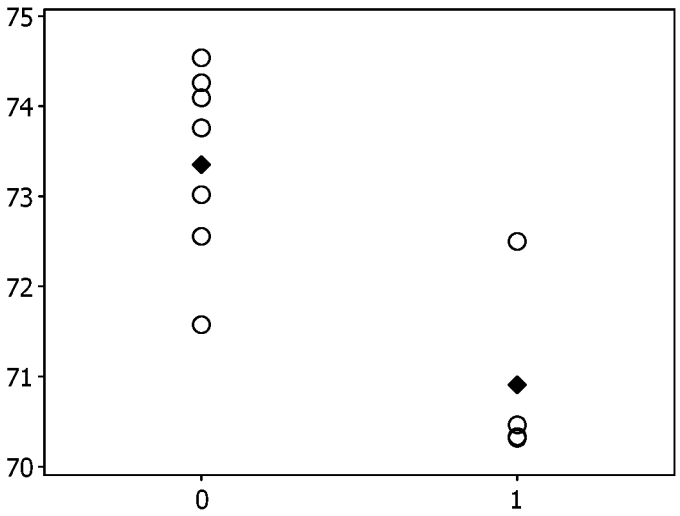
FIG. 8 represents the «Reflectance measured at 60°» in % as a function of the sharpness of the intersection between infeed as well as exit surface and land: 0 for a rounded intersection (5) with a radius between 0.5 to 4.6 mm and a rounded intersection (6) with a radius below 1.2 mm, 1 for sharp intersections (see FIG. 4). The diamond point is the mean value.

The fourth example deals with the impact of the die design on the reflectance. FIG. 8 shows that, in average on several runs with the same punch, the dies with a rounded intersection (5) (FIG. 4) with a radius from 0.5 to 4.6 mm and a rounded intersection (6) (FIG. 4) with a radius below 1.2 mm enable to produce cans with a higher reflectance. More specifically, combining a metal with a smooth external surface (Ra below 0.3 μm) and dies with rounded intersections enable to reach the highest values of reflectance (above 74%), better than the standard case by about 4%.

The invention claimed is:

1. A manufacturing process of aluminum alloy beverage cans comprising drawing and ironing an aluminum alloy sheet, wherein during the ironing step, a friction higher between a bodymaker punch and the aluminum sheet than between an ironing die and said aluminum sheet is produced by the aluminum sheet comprising a smooth surface aluminum sheet having a roughness Ra below 0.3 μm on both sides in combination with an extra rough punch.

2. A manufacturing process of aluminum alloy beverage cans comprising drawing and ironing an aluminum alloy sheet, wherein during the ironing step, a friction higher between a bodymaker punch and the aluminum sheet than between an ironing die and said aluminum sheet is produced by the aluminum sheet comprising a smooth surface aluminum sheet having a roughness Ra below 0.3 μm on both sides in combination with no internal cupper lubrication used in the process.

3. A manufacturing process of aluminum alloy beverage cans comprising drawing and ironing an aluminum alloy sheet, wherein during the ironing step, a friction higher between a bodymaker punch and the aluminum sheet than between an ironing die and said aluminum sheet is produced by the aluminum alloy sheet having an internal surface higher in roughness than an external surface, wherein the external surface, in contact with the die, has a roughness Ra below 0.3 μm, and the ironing die having a rounded intersection with a radius from 0.5 to 4.6 mm between an infeed surface and a land, a rounded intersection with a radius below 1.2 mm between said land and an exit surface, a roughness Ra below 0.03 μm in a working area, and a land width below 0.38 mm.

4. A manufacturing process of aluminum alloy beverage cans comprising drawing and ironing an aluminum alloy sheet, wherein during the ironing step, a friction higher between a bodymaker punch and the aluminum sheet than between an ironing die and said aluminum sheet is produced by:

the aluminum alloy sheet having an internal surface higher in roughness than an external surface, wherein the external surface, in contact with the die, has a roughness Ra below 0.3 μm, and the internal surface, in contact with the punch, has a roughness Ra above 0.4 μm, the bodymaker punch having a roughness Ra above 0.35 μm and an isotropic texture, and optionally the ironing die having a rounded intersection between an infeed as well as an exit surface and a land, with a surface in a working area having a roughness Ra below 0.03 μm and with a width of the land below about 0.38 mm.

5. The manufacturing process according to claim 4 which uses no internal cupper lubrication.

6. The manufacturing process according to claim 4, wherein said ironing die has a rounded intersection with a radius from 0.5 to 4.6 mm between said infeed surface and said land, and a rounded intersection with a radius below 1.2 mm between said land and said exit surface.

7. The manufacturing process according to claim 4, wherein the ironing die has a rounded intersection with a radius from 0.5 to 4.6 mm between an infeed surface and a land, a rounded intersection with a radius below 1.2 mm between said land and an exit surface, a roughness Ra below 0.03 μm in a working area, and a land width below 0.38 mm.

8. The manufacturing process according to claim 4 which uses no internal cupper lubrication, and wherein the ironing die has a rounded intersection with a radius from 0.5 to 4.6 mm between an infeed surface and a land, a rounded intersection with a radius below 1.2 mm between said land and an exit surface, a roughness Ra below 0.03 μm in a working area, and a land width below 0.38 mm.

9. The manufacturing process according to claim 4, wherein the aluminum alloy sheet has an external surface, in contact with the die, with a roughness Ra below 0.3 μm, and an internal surface, in contact with the punch, with a roughness Ra above 0.4 μm, wherein the punch has an extra roughness characterized by a roughness Ra above 0.35 μm, with an isotropic texture, and wherein the process uses no internal cupper lubrication.

10. The manufacturing process according to claim 4, wherein the aluminum alloy sheet has an external surface, in contact with the die, with a roughness Ra below 0.3 μm, and an internal surface in contact with the punch, with a roughness Ra above 0.4 μm, and the punch has a roughness characterized by a roughness Ra above 0.35 μm, with an isotropic texture, and wherein the ironing die has a rounded intersection with a radius from 0.5 to 4.6 mm between an infeed surface and a land, a rounded intersection with a radius below 1.2 mm between said land and an exit surface, a roughness Ra below 0.03 μm in a working area, and a land width below 0.38 mm.

11. The manufacturing process according to claim 4, wherein the aluminum alloy sheet has an external surface, in contact with the die, with a roughness Ra below 0.3 μm, and an internal surface, in contact with the punch, with a roughness Ra above 0.4 μm, wherein the punch has a roughness characterized by a roughness Ra above 0.35 μm, with an isotropic texture, the process uses no internal cupper lubrication, and the ironing die has a rounded intersection with a radius from 0.5 to 4.6 mm between an infeed surface and a land, a rounded intersection with a radius below 1.2 mm between said land and an exit surface, a roughness Ra below 0.03 μm in a working area, and a land width below 0.38 mm.

* * * * *